US005158027A

United States Patent [19]

Ingram

[11] Patent Number: 5,158,027

[45] Date of Patent: Oct. 27, 1992

[54] PRESSER FOOT FOR HOLLOW NEEDLE TUFTING APPARATUS

[75] Inventor: Gary L. Ingram, Ooltewah, Tenn.

[73] Assignee: Tapistron International, Inc., Ringgold, Ga.

[21] Appl. No.: 810,495

[22] Filed: Dec. 19, 1991

[51] Int. Cl.[5] ..... D05C 15/26; D05B 29/06

[52] U.S. Cl. ..... 112/80.08; 112/80.16; 112/80.73; 112/235

[58] Field of Search ..... 112/235, 236, 80.07, 112/80.08, 80.16, 80.7, 80.73

[56] References Cited

U.S. PATENT DOCUMENTS

| | | | |
|---|---|---|---|
| 1,142,082 | 6/1915 | Eichorn | 112/235 X |
| 2,563,916 | 8/1951 | Brussell | 112/235 X |
| 4,328,758 | 5/1982 | Souza et al. | 112/235 X |
| 4,549,496 | 10/1985 | Kile | 112/80.08 |
| 4,928,610 | 5/1990 | Akutsv | 112/235 X |
| 4,991,523 | 2/1991 | Ingram | 112/80.05 |
| 5,080,028 | 1/1992 | Ingram | 112/80.08 |

*Primary Examiner*—Werner H. Schroeder
*Assistant Examiner*—Paul C. Lewis
*Attorney, Agent, or Firm*—Alan Ruderman

[57] ABSTRACT

Tufting apparatus for producing textile goods includes a plurality of hollow needles which are reciprocated vertically to penetrate a backing. Yarn is fed pneumatically through the needles and implanted into the backing, the backing being shifted transversely by an amount corresponding to the space between adjacent needles so as to implant a transverse row across the backing. A knife blade is associated with each needle and positioned on the opposite side of the backing from a presser foot. The knife blade engages a point forming flat angled surface of the needle, the angled surface being formed with an upwardly and inwardly extending slot which serves to capture and center yarn exiting the needle and provides a sharp edge which cooperates with the knife blade for cutting the yarn. The presser foot includes a conduit disposed for blowing air under pressure toward the needle penetration opening to blow the limb of yarn severed from the needle down into the backing so that not only is the backing prevented from lifting when the needle is withdrawn, but the air acts to prevent the backstitch from standing up above the backing by reducing excess yarn as a result of the slot in the needle.

7 Claims, 2 Drawing Sheets

PRESSER FOOT FOR HOLLOW NEEDLE TUFTING APPARATUS

BACKGROUND OF THE INVENTION

This invention relates generally to apparatus for producing tufted textile goods such as carpet, upholstery, and the like, and more particularly to a presser foot for tufting apparatus capable of producing patterned tufted goods.

U.S. Pat. No. 4,549,496 which issued Oct. 29, 1985, to Kile discloses highly advantageous tufting apparatus for producing patterned tufted goods using yarns of different colors or different textures. This apparatus is capable of placing yarn into a backing to create patterns and designs which previously were generally available only from a weaving loom or by using printing techniques. The patented apparatus employs multiple heads spaced across the width of a backing material. Each head comprises a reciprocating hollow needle or backing opener tube for penetrating the backing and for implanting yarn tufts in the backing by feeding yarn through the needle pneumatically. The needle is connected to a yarn exchanger into which a plurality of yarns of different colors, for example, are supplied, and a mechanism is included which enables the selection of one or more of the yarns for implantation into the backing for each penetration by the needle. The multiple heads are stepped in synchronism across the backing for a distance corresponding to the spacing between the heads in order to implant a transverse row of yarn tufts. The backing is then advanced to the position of the next row and the process is repeated to implant the next row. A computer controls the selection of the yarn implanted by each backing opener for each penetration of the backing in order to produce a desired pattern in the finished goods.

A significant factor influencing the production speed of practical apparatus embodying the invention of the Kile patent is the number of tufting heads embodied in the apparatus. The greater the number of heads, the less distance each head must traverse and, accordingly, the faster a row of tufts can be implanted in the backing. As the number of heads increases, however, other problems arise. The increased weight makes it more difficult to move the heads accurately and to maintain their alignment and positions relative to one another. Thus rather than the multiple heads which carry the hollow needle being moved across the backing, Ingram U.S. Pat. No. 4,991,523 discloses the backing rather than the heads being shifted transversely to move substantially less weight transversely. This not only simplifies the transverse shifting apparatus but also provides greater speed and accuracy to the yarn placement.

Additionally, the aforesaid Pat. No. 4,991,523 discloses an improved yarn cutting mechanism having significant advantages over that disclosed in the Kile patent by providing a cutting mechanism wherein a cutting blade cooperates with the backing opener tube or needle and shears the yarn as the hollow needle reciprocates into shearing engagement with the blade so that the blade acts against an angled surface forming the needle point and a slot in the angled surface holds and centers the yarn. This provides improved cutting of the yarn after it has been implanted into the backing. Moreover, the cutting apparatus includes a mechanism for permitting the yarn to be selectively cut or not cut as desired so that loop pile, cut pile, and cut/loop pile fabrics may be produced.

Another significant factor influencing the cost and accuracy of such tufting apparatus is the control over the feeding of the yarn to the hollow needle. The feeding of the yarn must be positive, and when a yarn change is to be made for a particular needle the yarn previously stitched by that needle should be positively withdrawn from the needle so that the subsequent yarn will not be blocked by the previously sewn yarn. Unless this withdrawal of the previously sewn yarn is assured, a substantially greater air pressure is required to supply the subsequent yarn through the needle. Furthermore, when the yarn is withdrawn from the needle, unless the yarn withdrawal is controlled, the next time that yarn is required to be fed to the needle an accurate and consistent length of yarn can not be assured. This would also result in requiring additional pressure to assure that a sufficient length of yarn is supplied. The effect is that a larger than required amount of pressure must be utilized, and if too much yarn is supplied to the needle additional yarn shearing operations are required for producing a satisfactory product.

This problem was solved by the apparatus disclosed in Ingram U.S. Pat. No. 625,949. There a pullback mechanism is disposed between a yarn feed roller and the hollow needle, the pullback mechanism acting to pull the yarn a preselected amount from the needle so that the yarn passageway in the needle is not restricted by the previous yarn when a subsequent yarn is to be sewn. Additionally, to assure that the pullback mechanism draws yarn from the needle and not from the yarn supply or the feed roller, clamping apparatus is disposed between the yarn feed roller and the pullback mechanism for positively clamping the yarn when a yarn change is to be made. The pullback mechanism is thereafter activated and the yarn feed roller ceases positive feeding of the yarn. Thus, the yarn pullback mechanism draws a predetermined amount of yarn from the needle maintaining it in reserve until again required. Additionally, the yarn feed roller as it ceases positive feeding draws a preselected amount of yarn from the yarn supply for immediate subsequent use when needed. When the needle is to commence stitching with a particular yarn, the yarn feed roller is activated and the yarn clamping apparatus and yarn pullback mechanism are deactivated.

A further significant factor influencing the efficiency of the aforesaid apparatus and the appearance of the product produced thereby is the disposition of the yarn on the reverse side of the backing. Because of the hollow needle, the use of air to blow the yarn to form a loop, and the slot in the angled point forming surface which acts to capture and hold the yarn for cutting, when the needle is withdrawn from a first penetration of the backing and thereafter commences to make a second penetration spaced transversely from the first penetration, the yarn strand extending from the first penetration into the hollow of the needle after withdrawal of the needle from the first penetration is initially disposed against the side wall of the hollow and thereafter on the subsequent down stroke is captured by the slot in the rear of the needle, which is 90° therefrom. This results in excess yarns on the backing which forms a loop in the back stitch that stands above the surface of the backing rather than sitting flat thereon. In conventional tufting machines, for example, the looper or hook which cooperates with the needle holds the loop to pull the yarn so that the back stitch is disposed against the backing, and in conventional hollow needle tufting machines the needle does have the slot for aiding cutting of the yarn. Although this difficulty may be overcome by feeding either a greater amount of air to the needle or feeding air under a higher pressure, such a solution presents other problems such as possible unthreading of the yarn from the yarn exchanger of the apparatus. Thus, the present invention is directed toward an effective and efficient solution to this difficulty.

SUMMARY OF THE INVENTION

Consequently, it is a primary object of the present invention to provide apparatus for producing tufted textile products including a hollow needle through which a selected one of a plurality of yarns is fed pneumatically for insertion into a backing material upon penetration of the needle into the backing, and cutting means acting in conjunction with the needle to cut loops of yarn so formed, the apparatus including pneumatic means for preventing the backstitch between adjacent needle penetrations from standing up above the backing.

It is another object of the present invention to provide apparatus for producing tufted textile products including a hollow needle through which a selected one of a plurality of yarns is fed pneumatically for insertion into a backing material upon penetration of the needle into the backing, and cutting blade means acting in conjunction with the needle to cut loops of yarn so formed, the apparatus including a presser foot disposed above the backing, the presser foot having a clearance through which the needle reciprocates and into which air is fed under pressure to prevent the backstitch on the backing between adjacent needle penetrations from standing up above the backing.

It is a further object of the present invention to provide apparatus for producing tufted textile products including a hollow needle through which a selected one of a plurality of yarns is fed pneumatically for insertion into a backing material upon penetration of the needle into the backing, the needle having an angled surface forming a point and having a slot in the surface for holding the yarn in place while the yarn is cut by a blade acting in conjunction with the angled surface of the blade, the apparatus including a presser foot disposed above the backing, the presser foot having an opening through which the needle reciprocates and into which air is fed under pressure for blowing the severed yarn limb down into the backing, thereby to tighten the backstitch and prevent the backstitch from standing up above the backing.

Accordingly, the present invention provides a presser foot which not only acts conventionally to preclude the backing from lifting when the needle is withdrawn, but additionally acts to prevent the backstitch from standing up above the backing in tufting apparatus having a hollow needle through which yarn is fed pneumatically, especially such apparatus where the hollow needle includes a slot in an angled point forming surface serving to capture and center the yarn while it is being cut by a knife blade acting against said surface. The presser foot includes a conduit disposed for blowing air under pressure onto the severed yarn strand in the opening made by the needle. Preferably the presser foot includes a space through which the needle reciprocates and the air is blown into the space. Specifically, in the preferred form of the invention, the needle reciprocates through an opening in the presser foot and the air is fed through a bore communicating with the opening, the bore being at an angle to the center-line of the opening and thus the axis of the needle.

BRIEF DESCRIPTION OF THE DRAWINGS.

The particular features and advantages of the invention as well as other objects will become apparent from the following description taken in connection with the accompanying drawings in which.

DESCRIPTION OF THE PREFERRED EMBODIMENTS

As previously indicated, the present invention is particularly adapted for use with apparatus of the type disclosed in the previously referenced U.S. Pat. Nos. 4,549,496 and 4,991,523, the disclosures of which are incorporated by reference herein for producing tufted textile products, such as carpet, wall coverings or upholstery. Details of structure and operation of the improved tufting apparatus of the present invention which are not directly related to the present invention and which are not described herein may be found by reference to the aforesaid patents.

Figure 1:
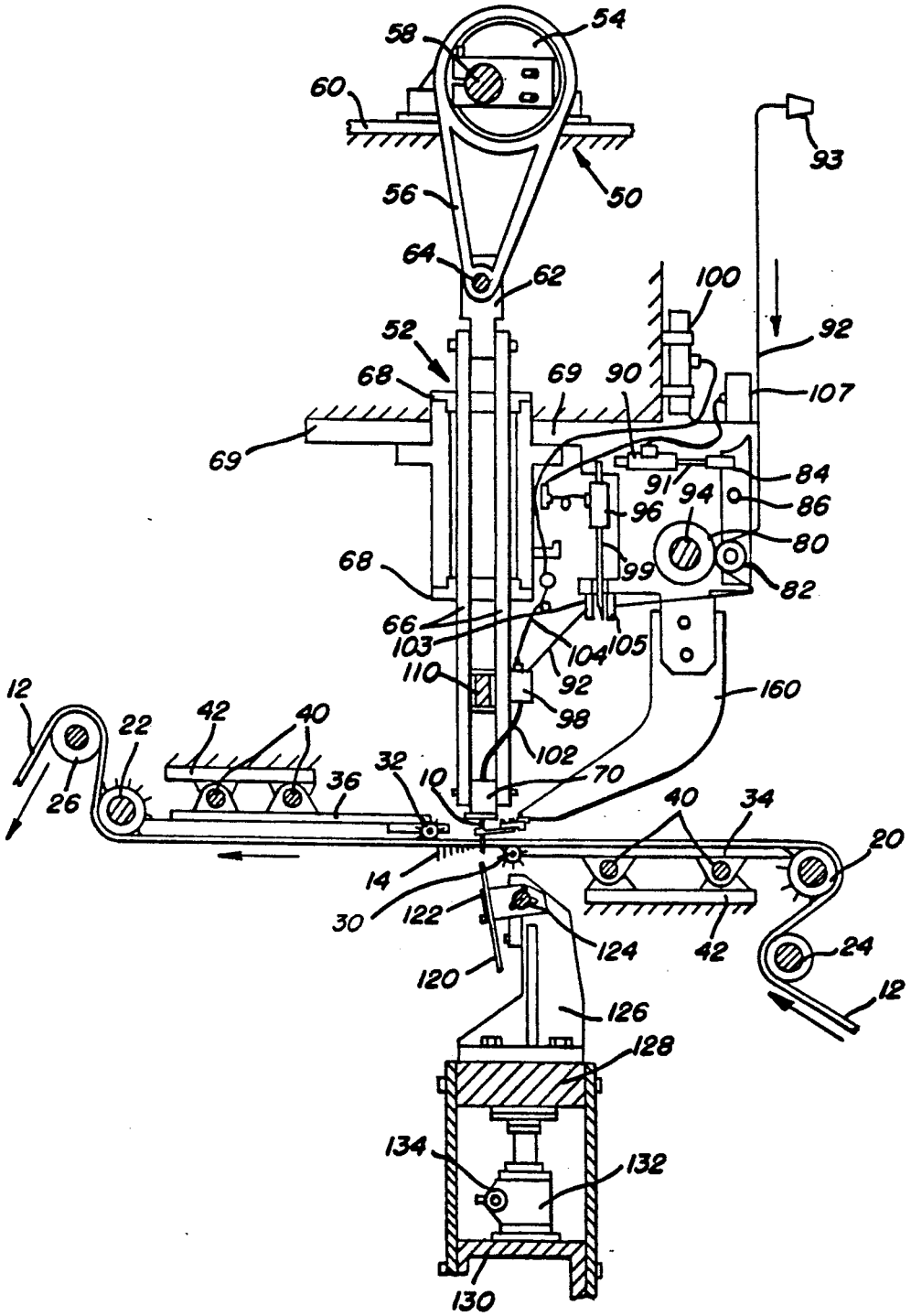
FIG. 1 is a side elevational view, partially in cross section and partially diagrammatic, of tufting apparatus embodying the invention.

The tufting apparatus of FIG. 1 comprises a plurality of reciprocating backing opener tubes or needles 10 (only one of which is illustrated) which, since they are hollow needles, are referred to as backing openers or needles for penetrating a primary backing 12 to implant yarn tufts 14 therein. The primary backing 12, which may be in the form of a continuous running web, for example, may be advanced longitudinally past the reciprocating needles (to the left in FIG. 1 as indicated by the arrow) by a backing advance or feeding system which may comprise a pair of pin rollers 20 and 22 which are driven (as by electric motors which are not illustrated) at slightly different rotational speeds so as to maintain the backing under tension as it passes the reciprocating needles. The backing advance system may further comprise a pair of guide rollers 24 and 26 which cooperate with the pin rollers 20 and 22, respectively, to guide the backing. As shown in the figure and for reasons which will be described in more detail shortly, a second pair of pin rollers 30 and 32, which may have smaller diameters than pin rollers 20 and 22, may be located closely adjacent to the reciprocating needles 10 on opposite sides of the backing. Pin rollers 30 and 32 provide better control of the backing in the area where the tufts are implanted. As shown in the figure, pin roller 30 may be carried on a bed plate 34 at the lower side of the backing and be disposed adjacent to the location at which the needles penetrate the backing. Pin roller 32 may be carried on a second plate 36 disposed at the upper side of the backing and located just downstream from the reciprocating needles. Plates 34 and 36 are transversely shiftable relative to the backing advance direction for reasons which will be described.

Pin rollers 20 and 22 may also be carried on the shiftable plates 34 and 36, respectively, as indicated in the figure. To enable transverse movement each of the plates 34 and 36 may be carried on a pair of transversely extending shafts 40 which are supported by fixed portions 42 of the frame of the apparatus. Plates 34 and 36 may be mechanically connected together and to a transverse positioning mechanism (not illustrated) which enables the plates as well as the pin rollers and their associated drive system to be shifted in unison transversely to the longitudinal direction of advancement of the backing. This produces a corresponding transverse shifting movement of the backing so that each needle may insert yarn into the backing at a number of transverse locations. The transverse positioning mechanism may be any of a number of commercially available devices, such as pneumatic or hydraulic cylinders, or a ball screw drive, which are capable of producing very small and precisely controlled movements. Preferably, the positioning mechanism enables precisely controlled movements of the order of a tenth of an inch or less. Rollers 24 and 26 may also be shifted transversely in correspondence with pin rollers 20 and 22 by a second, less precise shifting mechanism.

The needles 10 may be reciprocated by an adjustable cam assembly 50 which is coupled to the needles by a link assembly 52. The adjustable cam assembly may comprise a circular cam lobe member 54 rotatably supported by bearings within a circular portion of a yoke member 56. The cam lobe member is carried on and driven by a transversely extending rotating shaft 58 which is offset from the center of the cam lobe member preferably supported by bearings on a fixed portion 60 of the frame as shown. The link assembly 52 may comprise a coupling link 62 which is pivotably connected to yoke member 56 as shown at 64 and connected to a pair of vertically extending link members 66 which are guided for vertical reciprocating movement by linear bearings 68 supported by other fixed portions 69 of the frame. The lower ends of link members 66 are connected to yarn exchangers 70, each yarn exchanger carrying a respective one of the needles 10. Upon rotation of shaft 58, cam member 54 rotates to impart reciprocating movement to yoke member 56 and, in turn, a similar movement to the needles via the link assembly to cause the needles to penetrate and withdraw from the backing repetitively.

The tufting apparatus of FIG. 1 also includes systems for supplying and controlling the yarn which is implanted into the backing. These systems include a yarn feed system for positively supplying a predetermined length of selected yarn to the yarn exchanger for each needle. The yarn feed system comprises a drive roller 80 which cooperates with a feed roller 82 carried on a movable member 84 which is pivotably supported on a journal member 86 on the frame portion 69, there being one roller 82 carried on a member 84 for each yarn supplied to each needle or backing tube opener 10. Each feed roller 82 may be urged into engagement with a respective drive roller 80, which may be a single roller for a number of feed rollers, by means of a respective pneumatic actuator 90 or the like which is connected to the pivotable member 84 by means of a rod 91 extendable and rectractable from the actuator 90 so as to pivot the member 84 to urge the respective rollers 80 and 82 into contact with one another. Yarn 92 fed from a yarn supply such as a yarn cone 93 mounted on a creel (not illustrated) may be guided around the periphery of roller 82 so as to be between the engaging peripheral surfaces of rollers 80 and 82. The drive roller 80 may be supported on an incrementally rotated drive shaft 94 so that upon the shaft being rotated with the rollers 80 and 82 engaged, yarn is positively fed to the yarn exchanger 70 via a yarn pullback mechanism 96 and via a yarn ejector device 98. Thus, the yarn is trained so as to make a tortuous path about the roller 82 thereby resulting in a predetermined length of yarn being drawn from the yarn supply as the member 84 is pivoted to disengage the roller 82 from the roller 80. The yarn so drawn from the supply is thus ready for feeding toward the respective needle when the member 84 is again pivoted to engage the roller 82 with the roller 80.

The yarn pullback mechanism 96 for each needle includes a rod or plunger 99 having a passageway or eyelet which moves relative to a pair of yarn guides 103,105 fixed to the frame, and the plunger 99 is disposed between the yarn guides 103,105. This mechanism acts to retract yarn from the needle 10 after a stitch has been formed and cut by the cutting apparatus hereinafter described and which is described in detail in U.S. Pat. No. 4,991,523, the yarn preferably being pulled into the yarn exchanger 70. A yarn ejector device 98 associated with each needle receives a plurality of different yarns (only one yarn 92 being illustrated in the drawings), each yarn having a separate passageway, along with pressurized air directed into each passageway from a pneumatic supply device 100. The supply device 100 supplies high pressure air to the passageway having yarn that has been selected for ejection into the needle or backing tuhe opener and supplies low pressure air to the other passageways, the pressure selection being by pressure regulators and control means (not illustrated). Each yarn strand entering the ejector device 98 is fed to the yarn exchanger 70 through a separate supply tube 102 which connects the ejector device to the yarn exchanger. A separate air line 104 for each yarn tube 102 is connected to the ejector device 98 to enable compressed air to be ejected into each yarn passageway in a controlled manner selectively to transport the selected yarn pneumatically under the higher pressure through the tube to the backing opener. The low pressure air supplied to the ejector 98 and thus the other air supply tubes ensure that the other yarns are available without delay after another respective yarn has been selected to be transported to the needle or backing tube opener. Additionally, the same or preferably, another pneumatic supply 107 may supply pressurized air to the actuator 90 and the pullback mechanism 96.

The yarn ejector device 98, yarn supply tubes 102 and yarn exchanger 70 together function in a similar manner to the yarn exchanger described in U.S. Pat. No. 4,549,496 and operate in a similar manner, the difference being that in the aforesaid patent the yarn exchanger and the yarn ejection device were incorporated into a common unit. A particular yarn may be selected for implantation into the backing by appropriately controlling the air supplied to the respective pneumatic actuator 90 to pivot the member 84 associated with the selected yarn so that the corresponding feed roller 82 is moved into engagement with the drive roller 80; by controlling the air supplied to the yarn pullback mechanism 96 to extend the plunger 99 and release the yarn previously drawn from the yarn supply; and by controlling the compressed air supplied to the ejector device 98 to transport the selected yarn to the yarn exchanger when the actuator 90 is actuated to extend the rod 91, the member 84 is pivoted to force the roller 82 against the roller 80 so that the yarn 92, which initially is the yarn held in reserve, is fed toward the respective needle or backing opener tube. Additionally, the plunger 99 is extended from the pullback mechanism 96 so that the eyelet or passageway therein is aligned with the guides 103, 105 to permit the yarn to be fed toward the needle, the extension of the rod 91, the member and the plunger occurring substantially simultaneously. When the actuator 90 is controlled to retract the rod 91, the member 84 is pivoted to disengage the roller 82 from the roller 80 and terminate the feeding of the previously fed yarn. Also, the plunger 99 is retracted into the pullback mechanism to draw back yarn that has been fed but not used by the needle and held ready, as in a storage tank or plenum, until that yarn is again fed. The pullback mechanism 96 thus ensures that a previously fed yarn is drawn back into the vicinity of, and preferably into, the yarn exchanger 70 so that a blockage does not occur within the needle 10 which would restrict the feeding of the subsequently fed yarn. This permits substantially less air pressure to be required to feed the yarn from the yarn exchanger to the needle. A clamping means (not illustrated) between the pullback mechanism and the feed roller 82 ensures that yarn is drawn back from the needle rather than from the yarn supply, and to preclude any yarn from being drawn from the reserve resulting when the feed roller 82 is moved out of engagement with the drive roller 80, and also ensures that the extra yarn drawn by roller 82 when moving from roller 80 is available to be supplied to the needle.

The tufting apparatus in FIG. 1 employs a plurality of transversely stationary needles which are connected together, as by a transversely extending bar 110. The apparatus may employ several adjustable cam assemblies 50 spaced transversely across the width of the backing and connected to shaft 58 to reciprocate the needles in synchronism to penetrate the backing. Each needle implants one or more selected yarns as determined by a control system such as a computer which controls the yarn supplying and other systems of the apparatus. In order to implant a transverse row of tufts, the backing is shifted transversely, as previously described, in small increments corresponding to the spacing between adjacent tufts. By using a large number of needles spaced apart by relatively small spacings, e.g., 2.5 inches, the backing need be shifted transversely only by this rather small total distance in order to implant a complete transverse row of tufts. The combination of the shifting large diameter pin rollers 20 and 22 and the small diameter pin rollers 30 and 32 spaced closely adjacent to the needle region afford good control over the backing as it is shifted transversely and avoids any tendency of the backing to skew. Rollers 24 and 26, which respectively guide the backing onto pin roller 20 and from pin roller 22, may also be shifted transversely by a separate shifting mechanism as previously indicated.

Figure 2:
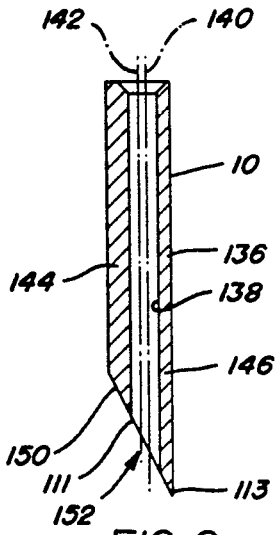
FIG. 2 is a longitudinal cross sectional view of a needle in the apparatus illustrated in FIG. 1.
Figure 3:
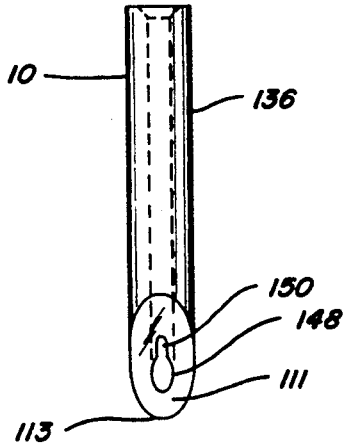
FIG. 3 is a rear elevational view of the needle illustrated in FIG. 2.

As illustrated in FIG. 1, and as described in detail in the aforesaid U.S. Pat. No. 4,991,523, the tufting apparatus includes a cutting mechanism comprising a separate knife blade 120 for each needle. The blades are disposed on the opposite side of the backing from the needles and the needle reciprocating mechanism, as indicated in FIG. 1, and are arranged to cooperate with the needles by sliding over the respective angled surface 111 which forms the pointed tip 113 of the hollow needle, as illustrated in FIGS. 2 and 3, in a shearing-like action to cut yarn that is ejected from the needles. As shown in FIG. 1, knife blade 120 may comprise a flat elongated strip of metal, such as steel, which is held clamped in a knife block 122 disposed on a transversely extending keyed shaft 124 supported by several transversely spaced brackets 126 (only one of which is illustrated) connected to a transversely extending frame member 128. The brackets 126 may be clamped tightly to shaft 124 normally to hold the shaft stationary, and means may be provided to permit the shaft to be rotated to change the angle between the knife blade and the needle and to shift the knife blades transversely as necessary. Frame member 128 is preferably supported on a fixed member 130 of the apparatus frame by several screw-type jacks 132 (only one being shown) which are spaced transversely in the apparatus. The control shafts 134 of the jacks may be connected together by control rods so that the jacks may be lowered and raised in unison to adjust the positions of the knife blades relative to the backing.

As best illustrated in FIGS. 2 and 3 the needle or backing tube opener 10 comprises a hollow tube 136 which has a bore 138 having an axis 140 which preferably is offset in the front to rear direction from the axis 142 of the tube, i.e., the exterior of the tube 136, so that the rear wall 144 of the tube has an increased thickness relative to the front wall 146. Because of the angled surface 111 relative to the bore 138, the opening 148 of the bore 138 in the surface 111 has an elliptical shape and a slot 150 is formed in the upper region of the opening. The bottom wall of the slot 150 is angled upwardly away from the tip at an obtuse angle relative to the surface 111 and inwardly toward the axes thereby forming a sharp edge in the surface 111. The slot 150 serves to capture and center yarn exiting the opening 148 and holds the yarn while it is being cut by the knife blade 120, and the increased thickness of the wall 144 provides an increased length for the slot which aids in this function. However, as aforesaid, the slot 150 although aiding in the cutting operation, presents a difficulty since on a down stroke subsequent to a first penetration and spaced transversely thereto, the yarn extending from the first penetration is diverted by 90° from the side wall of the needle to the slot as it is captured by the slot and thus results in excess yarn on the rear of the backing so that the backstitch thereafter formed is raised above the surface.

Figure 4:
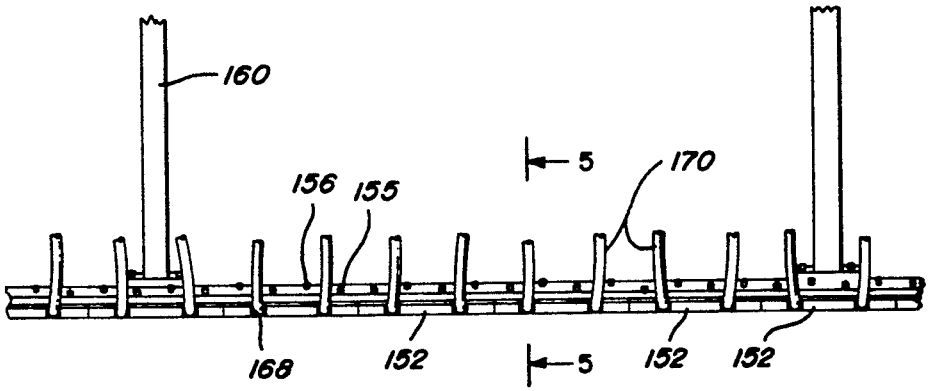
FIG. 4 is a rear elevational view of a fragment of the presser foot portion of the apparatus illustrated in FIG. 1.
Figure 5:
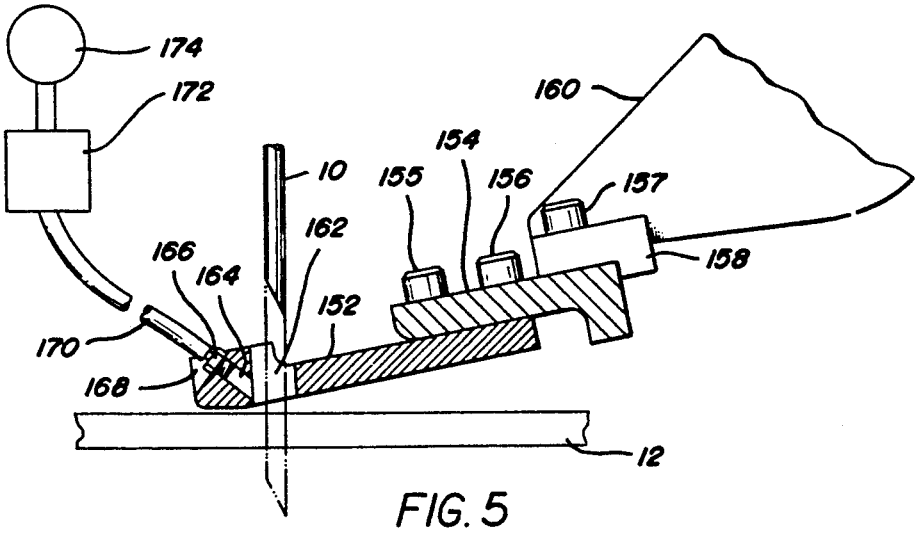
FIG. 5 is a cross sectional view taken substantially along line 5—5 of FIG. 4.

In order to overcome the above mentioned difficulty of the backstitch standing above the surface of the backing, the present invention provides an improved presser foot construction, each foot 152 comprising a substantially rectangular plate. There are a plurality of such feet disposed transversely across the machine in gang fashion, as illustrated in FIG. 4, and all of the feet are connected to an elongated rail member 154 by means of cap screws 155, 156, the screws preferably being staggered or offset in two rows. The rail member 154 is also connected by screws 157 to a plurality of base member feet 158 disposed, at the respective free ends of a plurality of elongated arms 160, the other end of each of the arms being fastened securely to the frame of the tufting apparatus as illustrated in FIG. 1. Conventionally, a presser foot is a plate disposed adjacent the needles slightly above the backing material so that the backing is not raised as the needles exit or withdraw from the backing. Accordingly the arm 154 is disposed such that each presser foot 152 is slightly above the backing material 12 and extends toward the needles. In the preferred form of the invention each presser foot extends beneath two adjacent needles and includes a bore 162 corresponding to each needle and through which the respective needle may reciprocate freely. Communicating with each bore 162 is a smaller bore defining a conduit 164. Of course if the presser foot had a slot or other clearance for the needle rather than a bore through which the needle reciprocates, the conduit 164 could be external of the presser foot and would merely be disposed so that its axis is diverted toward the clearance and the axis of the path of the needles. A hose nipple or fitting 166 is disposed within a small cut-out 168 formed in the presser foot and has one end positioned and secured within the outer end of each conduit 164, i.e., the end remote from the bore 162. An air hose 170 is fitted to the outer end of each fitting 166 and feeds air from a pressure regulator 172 supplied with air from a pressurized source 174. Thus, air may be supplied through the conduit 164 at a regulated pressure to the bore 162 and directed into the opening left by the needle as the needle is withdrawn therefrom. This apparently forces the severed limb of yarn, i.e., the limb forming the last backstitch and which is no longer connected to the needle, down into the opening before the needle makes a subsequent opening to eliminate the excess yarn on the rear of the backing so as to preclude the yarn from forming a backstitch raised above the surface of the backing material. As illustrated, the bore forming the conduit 164 is disposed at an angle relative to the axis of the needle 10, the angle providing the best results being in the order of approximately 45°.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. Tufting apparatus for producing tufted fabric goods from a backing material web and a length of yarn, said web having first and second surfaces, said apparatus comprising a longitudinally elongated needle having a pointed tip defined by an angled surface, a hollow passageway extending through said needle, means for supplying yarn through said passageway and outwardly from said angled surface, means for reciprocating said needle along an axis for penetrating said backing and for withdrawal therefrom, knife blade means disposed adjacent said first surface of said backing for cooperating with said angled surface to cut yarn extending from said needle to form a yarn limb in the backing separated from said needle while said needle penetrates said backing, a pressure foot disposed adjacent said second surface of said backing having a clearance through which said needle may reciprocate, conduit means communicating with said clearance and directed toward said backing and toward the axis of reciprocation of said needle, and means for feeding pressurized air to said conduit for blowing said limb into said backing toward said first surface.

2. Tufting apparatus as recited in claim 1, wherein said needle includes a slot in said angled surface remote from said pointed tip for receiving a length of yarn exiting said passageway, said slot cooperating with said angled surface to define a sharp edge for cooperating with said knife blade means to hold the yarn as the yarn is cut by said knife blade means, and said conduit means being disposed for feeding said pressurized air toward the disposition of said slot.

3. Tufting apparatus as recited in claim 2, wherein said conduit is disposed at an angle to said backing and said axis of reciprocation.

4. Tufting apparatus as recited in claim 1, wherein said clearance comprises a bore extending through said presser foot.

5. Tufting apparatus as recited in claim 4, wherein said conduit extends through said presser foot and opens onto said bore.

6. Tufting apparatus as recited in claim 5, wherein said needle includes a slot in said angled surface remote from said pointed tip for receiving a length of yarn exiting said passageway, said slot cooperating with said angled surface to define a sharp edge for cooperating with said knife blade means to hold the yarn as the yarn is cut by said knife blade means, and said conduit means being disposed for feeding said pressurized air toward the disposition of said slot.

7. Tufting apparatus as recited in claim 6, wherein said conduit is disposed at an angle to said backing and said axis of reciprocation.

* * * * *